United States Patent [19]

Morin

[11] Patent Number: 4,683,840

[45] Date of Patent: Aug. 4, 1987

[54] BOILER WITH A CIRCULATING FLUIDIZED BED

[75] Inventor: Jean-Xavier Morin, Neuville aux Bois, France

[73] Assignee: Framatome, Courbevoie, France

[21] Appl. No.: 905,094

[22] Filed: Sep. 5, 1986

[30] Foreign Application Priority Data

Sep. 9, 1985 [FR] France ..... 8513355

[51] Int. Cl.[4] ..... F22B 1/00; F23C 11/02

[52] U.S. Cl. ..... 122/4 D; 110/214; 110/216; 110/245; 110/263

[58] Field of Search ..... 110/245, 263, 203, 204, 110/210, 211, 214, 233, 234; 122/4 D; 34/57 A; 431/7, 170, 173; 432/5 B; 165/104.16; 60/39, 464

[56] References Cited

U.S. PATENT DOCUMENTS

| | | | |
|---|---|---|---|
| 4,103,646 | 8/1978 | Yerushalmi et al. | 122/4 D |
| 4,426,958 | 1/1984 | Hosek et al. | 122/4 D |
| 4,442,797 | 4/1984 | Strohmeyer, Jr. | 122/4 D |
| 4,469,050 | 9/1984 | Korenberg | 122/4 D |
| 4,579,070 | 4/1986 | Lin et al. | 122/4 D X |

FOREIGN PATENT DOCUMENTS

| | | | |
|---|---|---|---|
| 92622 | 12/1982 | European Pat. Off. . | |
| 3107355 | 9/1982 | Fed. Rep. of Germany . | |
| 2328507 | 5/1977 | France . | |
| 2527478 | 5/1982 | France . | |
| 3810 | 1/1981 | Japan | 110/245 |
| 300861 | 8/1954 | Switzerland . | |
| 108710 | 8/1917 | United Kingdom . | |

OTHER PUBLICATIONS

"Fluidized-Bed Boilers Achieve Commercial Status Worldwide," Schwieser, Power, Feb. 1985, vol. 2, pp. 1-16.

*Primary Examiner*—Albert J. Makay
*Assistant Examiner*—Steven E. Warner
*Attorney, Agent, or Firm*—Pollock, Vande Sande & Priddy

[57] ABSTRACT

Boiler with a circulating fluidized bed, comprising a fluidization column completely lined with refractory material, a recirculation cyclone (2) and a duct (3) for recycling the solid materials. At least one heat-exchanger component (25, 26, 27) is placed in the recirculation cyclone (2). Pipe lines (30) enable air to be injected in tangential directions into the upper part of the cyclone (2) and thereby to increase the vortex effect. The combustion takes place substantially in the upper part of the cyclone (2). The fluidization column (1) comprises a widened section (1*a*) in its lower part.

5 Claims, 4 Drawing Figures

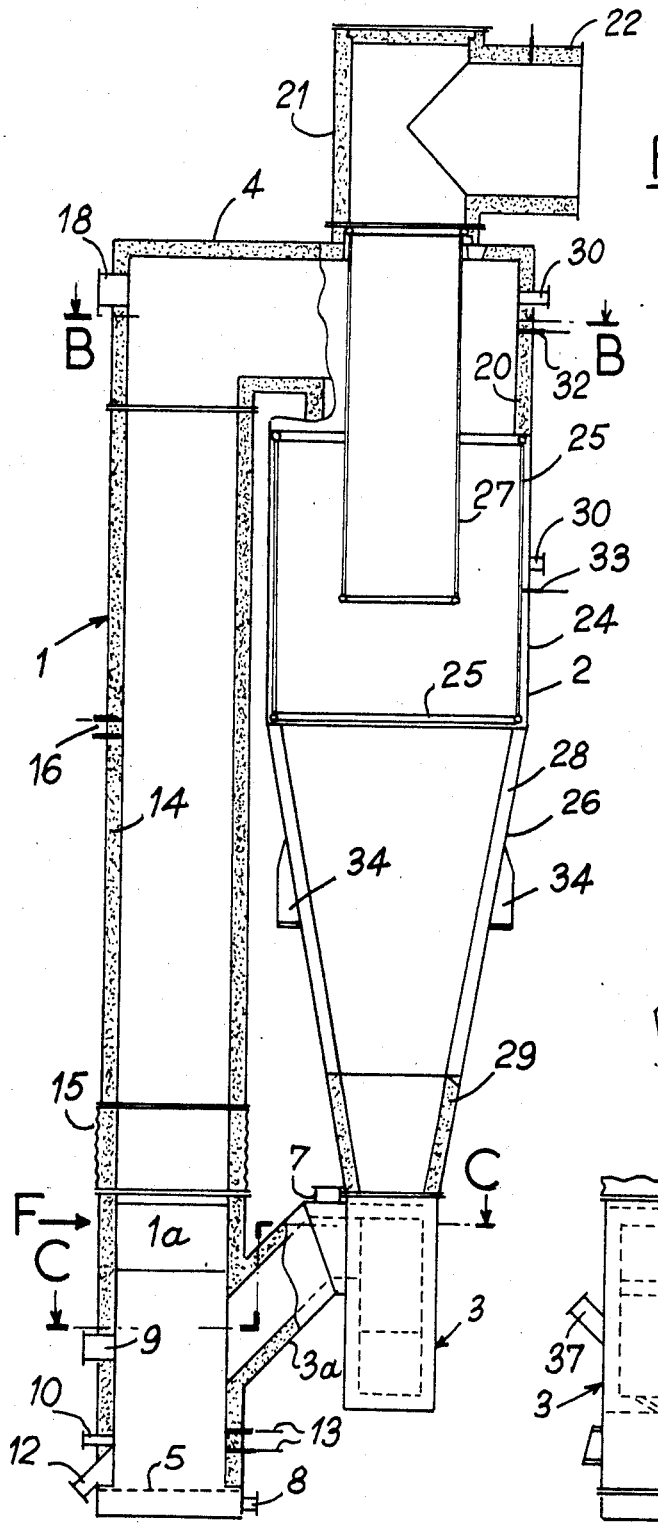
FIG.1
FIG.3
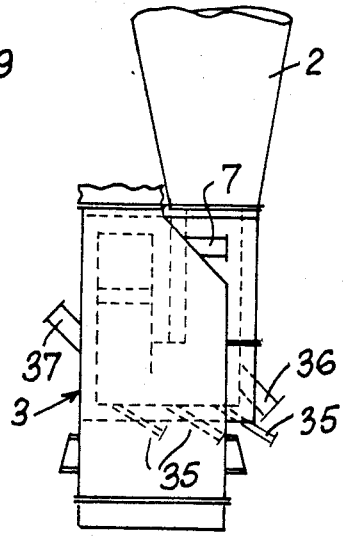

BOILER WITH A CIRCULATING FLUIDIZED BED

FIELD OF THE INVENTION

The invention relates to a boiler with a circulating fluidized bed utilizing the heat produced by the combustion of circulating materials.

Boilers of this kind generally comprise a principal body forming an elongate fluidization chamber arranged with its axis vertical, a recirculation cyclone communicating with the upper part of the fluidization chamber, a recirculation leg or duct providing communication between the lower part of the cyclone and the lower part of the principal body, and one or more heat-exchanger components in which water heating and vaporization are produced by thermal contact with the gases and solid materials at a high temperature which circulate in the boiler. The combustible materials and, if appropriate, non-combustible materials in the form of solid particles are introduced at the base of the fluidization chamber and are suspended in an oxidizing gas which is generally air travelling upwards in this chamber, at a sufficient velocity to entrain a substantial part of the solid particles towards the top of the fluidization chamber and thence into the recirculation cyclone.

PRIOR ART

Three principal types of fluidized-bed boilers are known, differing chiefly in the construction and the functions of the principal body forming the fluidization chamber in particular.

In a first type of boiler, the principal body comprises double-skin walls, forming the heat exchanger, and the combustion proceeds in this principal body, within a fluidized medium travelling at a velocity of the order of 5 to 6 meters/second. The inner walls of the principal body, which form the exchange surfaces, collect directly the heat produced by the combustion, which is regulated so as to take place in the optimum temperature range for the desulfurization of the fuel, while taking place with a reasonable excess of air. This type of boiler has relatively satisfactory operating characteristics; its performance is limited, however, by the fact that the suspension density of the solids still remains low (10 to 30 kg/Nm$^3$ of flue gas), owing to the fact that the transfer coefficient, the value of which is generally between 50 an 80 kcal/m$^2$h°C., is limited by the presence of a layer of solid materials lying flat against the exchange walls, and the fact that the zone for pregasifying the solid materials, at the base of the principal body, is very small in volume, with the result that the discharges of nitrogen oxide in the gases are relatively large because of the use of a significant excess of air (of the order of 20%).

A second type of boiler with a circulating fluidized bed comprises a principal body whose inner wall is partially lined with refractory material and partially equipped with double-skin walls, in its upper part. An external heat exchanger is associated with the boiler and receives solid particles removed from the recirculation leg at the exit of the cyclone and reinjected into the principal body. The removal of solid materials and their cooling in the external exchanger make it possible to ensure a heat balance so as to operate in an optimum temperature region for desulphurizing the fuel with a reasonable excess of air, which is still of the order of 20%. The fluidization velocities in the principal body are slightly higher than in the first type of boiler (6 to m/s).

However, the density of the suspended materials and the heat-transfer coefficient in the upper part of the principal body remain more or less identical to those in boilers of the first type. On the other hand, the transfer coefficient reaches a value of approximately 300 to 350 kcal/m$^2$h°C. in the outer exchanger, which operates as a low-velocity fluidized bed in order to limit the erosion of the exchanger tubes immersed in the fluidized bed.

A boiler of this kind still has the disadvantage of requiring an external exchanger and circuits for fluidizing agents, for gas discharge and for removing and reinjecting solids associated with this external exchanger; the circuit for removing solids must incorporate a valve for controlling the quantitites removed. As a result of this, the construction of boilers of this kind demands relatively high additional capital costs.

A third type of boiler has a small principal body whose inner surface is entirely lined with a refractory material and which communicates with a recirculation cyclone, as in the boilers of other types. This type of boiler also comprises an external exchanger whose transfer walls are placed in contact with the particles removed from the recirculation leg, which particles are then reinjected into the principal body. In a boiler of this type the fluidization velocity is very high (8 to 10 m/s) and heat transfer takes place wholly outside the principal circulation loop of the fluidized bed. The disadvantage of this type of boiler is that, as before, it requires a loop for circulating additional solids, in which the external exchanger is sited, and this is reflected in an increased cost of construction. It is also necessary to introduce particles of very large particle size at the bottom of the principal body, these particles not being circulated and making it possible to produce artificially a dense phase capable of trapping and of converting the fine fuel particles which are reintroduced at the bottom of the principal body.

SUMMARY OF THE INVENTION

The purpose of the invention is therefore to provide a boiler with a circulating fluidized bed making use of the heat produced by the combustion of circulating materials and comprising an elongate fluidization chamber with a vertical axis, whose inner surface is entirely lined with a layer of refractory material, and at the base of which a combustible material is introduced, together with, if appropriate, a non-combustible solid material in the form of particles, as well as an oxidizing gas for suspending the said solid materials travelling upwards in the chamber, at least one recirculation cyclone with a vertical axis, in communication with the upper part of the fluidization chamber via a duct arranged substantially tangentially to the recirculation cyclone, a duct for recycling solid materials, placing the lower part of the recirculation cyclone in communication with the lower part of the fluidization chamber, and at least one heat-exchange component in which the water to be heated and vaporized is circulated and whose outer transfer surface comes into contact with the hot circulating gases and solid materials, a boiler which enables very good operating performance to be obtained and whose construction and maintenance costs are limited.

To this end, at least one heat exchanger component is placed inside the recirculation cyclone, at least in its upper part which comprises means ensuring the combustion of the combustible gases and the solids circulating in this part of the cyclone.

In a preferred embodiment, the recirculation cyclone comprises, at least in its upper part, means for injecting air into the circulating fluidized bed, which are arranged in substantially tangential directions relative to the cyclone.

BRIEF DESCRIPTION OF THE DRAWINGS

In order that the invention may be more clearly understood, a description will now be given, by way of example, with reference to the attached drawings, of an embodiment of a boiler with a circulating fluidized bed according to the invention.

FIG. 1 is a view in vertical section along A—A of FIG. 2, of a boiler with a circulating fluidized bed according to the invention.

FIG. 3 is a view along F of FIG. 1.

FIG. 1 shows the whole boiler comprising a principal body 1 of elongate shape with a vertical axis, a recirculation cyclone 2 whose shape is that of a cylinder and a conical frustum and a recirculation leg 3.

Figure 2:
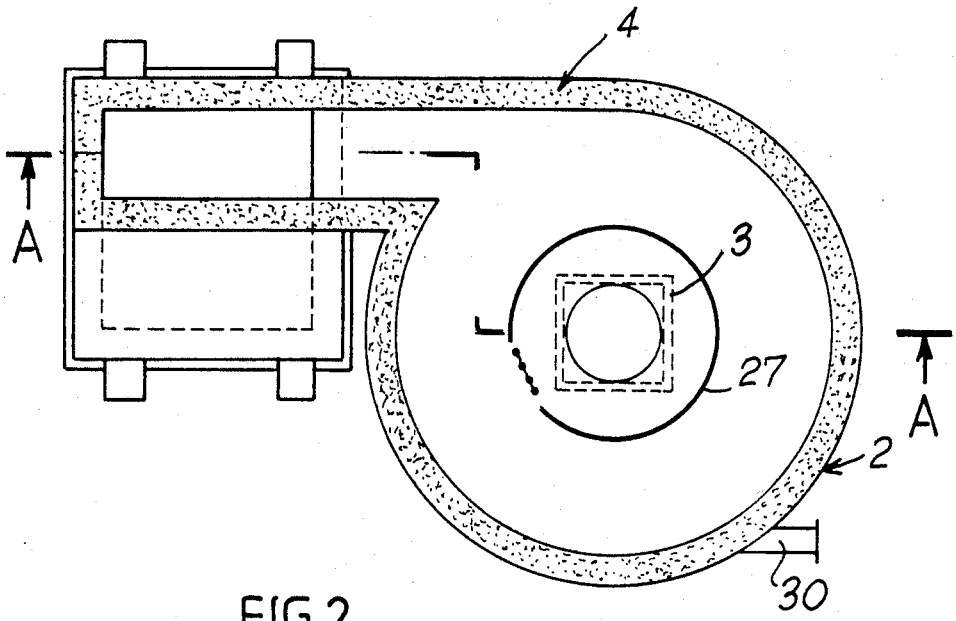
FIG. 2 is a view in section along B—B of FIG. 1.

The upper part of the principal body 1 communicates with the upper part of the cyclone 2 via a duct 4 directed tangentially with respect to the cyclone 2, as can be seen in FIG. 2. The recirculation leg 3, J-shaped, as can be seen in FIG. 3, provides communication between the lower part of the recirculation cyclone 2 and the lower part of the principal body 1. The boiler components 1, 2, 3 and 4 form the circulation loop of the fluidized bed.

The lower part of the principal body 1 receives the solid materials which are introduced into the end chute 3*a* of the recirculation leg 3 via a pipeline 7; these solid materials consist, for example, of coal particles forming the fuel and of limestone particles forming a desulfurizing and heat-carrying material. These solid materials are received by a fluidization grid 5 placed at the lower end of the principal body 1 and under which there opens a pipeline 8 for the injection of primary air producing the fluidization of the solid materials in the lower part of the principal body 1, which forms the fluidization chamber of the boiler.

Figure 4:
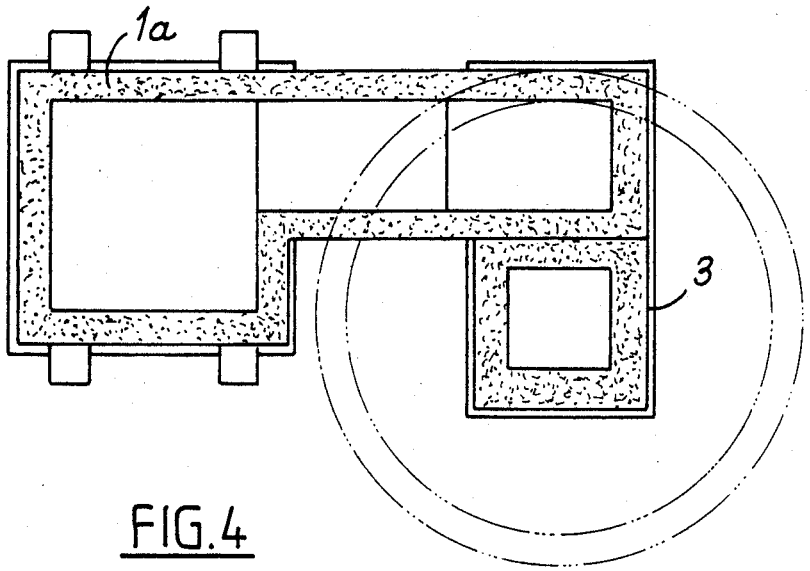
FIG. 4 is a view in section along C—C of FIG. 1.

As can be seen in FIGS. 3 and 4, this lower part of the principal body 1 has a square cross-section which is widened in relation to the generally rectangular section of the principal body which can be seen in FIG. 2.

As can be seen in FIG. 1, this lower part 1*a* receives, in addition to the fluidization means 5, 8, the burner 9 for starting up the boiler, a preheating burner 10, a duct 12 for the removal of ash, and thermocouples 13 enabling the temperature in this region of the boiler to be determined, for process control.

The inner surface of the principal body 1 forming the fluidization chamber is entirely lined with a refractory material 14 providing protection to its outer metal casing in which an expansion joint 15 is inserted in the lower part. Thermocouples 16 pass through the upper part of the wall of the principal body 1. The principal body 1 also comprises a safety valve 18 at its upper end, which is connected to the duct 4 for a tangential delivery of the bed circulating in the recirculation cyclone 2.

The cyclone 2 comprises an upper part 20 which is entirely lined with refractory material and whose upper part communicates with a chamber 21 for discharging flue gases which are conveyed by means of a pipeline 22 which is lined internally with refractory material, towards a heat-recovery and dust-removal plant of the type which is usually employed in combination with circulating-bed boilers.

Above its part 20 which is lined with refractory material, the recirculation cyclone 2 comprises a cylindrical part 24 whose inner wall carries a heat exchanger 25 in which water circulates, the whole of the inner wall of the cyclone part 24 forming a transfer surface. The flue gas removal chamber 21 communicates with the cyclone part 20 via a separator tube 27 whose wall forms a wall of a heat exchanger in which water circulates.

The lower part 26 of the cyclone 2 frusto-conical in shape, comprises over a major part of its height a double-skin wall in which water circulates, forming a heat exchanger 28 and, in its lower part, over a small height, a wall 29 lined internally with refractory material, this lower part communicating directly wih the recirculation leg 3, also lined with refractory material.

Pipelines 30 for introducing secondary air into the cyclone, in a direction which is substantially tangential to the latter, are placed both in the upper part 20 and in the cylindrical upper part 24 of this cyclone. Thermocouples 32 and 33 pass through the cyclone wall in the region of its part 20 and of its part 24, respectively. Supporting ribs 34 are welded onto the external surface of the frusto-conical part 26 of the cyclone.

The lower part of the recirculation cyclone 2 communicates with the recirculation leg 3, the shape of which can be seen by referring to FIGS. 1 and 3. This recirculation leg has a J shape, and this makes it possible to form a lock for the gas circulating in the lower part 1*a* of the fluidization chamber, and thus to prevent the travel of this gas from the principal body 1 to the cyclone 2 via the recirculation duct 3. The solid materials separated from the gases reaching the lower part of the cyclone and consisting chiefly of combustion ash and of heat-carrying limestone particles spill over into the vertical entry part of the recirculation duct 3 and are then received on the horizontal bottom of this duct; recirculation of these particulate solids is ensured by recirculation air injection nozzles 35 which pass through the horizontal bottom of the recirculation leg 3. The solid materials caused to circulate by the nozzles 35, which slope towards the outlet of the leg 3, rise in its vertical outlet section from which they spill over into the chute 3*a* communicating with the part 1*a* of the fluidization chamber. A proportion of the solid materials arriving in the recirculation leg 3 may be discharged via a pipeline 36 which is connected to a circuit which incorporates an external heat exchanger, it being possible for this discharge to be regulated by a valve for controlling the rate of extraction of solid materials. The external exchanger circuit extends back into the recirculation leg 3 by virtue of a pipeline 37 for reinjecting the cold solid materials.

The boiler according to the invention which has been described operates as follows: Coal and limestone in particulate form are introduced into the lower part 1*a* of the fluidization chamber, and primary air is introduced under the grid 5 by means of the pipelines 8. The primary air travelling upwards in the fluidization chamber 1 entrains the solid particles towards the top of this chamber. The widened section 1*a* at the base of this chamber 1 makes it possible to trap the large-size particles whose entrainment towards the upper part is impeded by the narrowing down of the chamber.

When the boiler is started up, the start-up burner 2 enables the temperature to be raised in the enclosure, and this then permits the introduction of the fuel, which consequently undergoes pre-pyrolysis and gasification in the zone 1*a*. The process is carried out in a reducing regime in this zone 1*a*, the air introduced into the bottom of the chamber 1 being restricted to the air quantity which is required for fluidization.

This method of operation with a secondary reaction zone at the base of the chamber 1 makes it possible, in particular, to reduce the nitrogen oxide discharges in the gases and to avoid the entrainment of large particles of fuel towards the upper part of the cyclone, where these particles could damage the refractory lining material. These large-size particles can be broken down and converted inside the zone 1*a*. This zone 1*a* also has the advantage of promoting the mixing of the fuel introduced with the solid materials recirculated via the leg 3.

Besides the fluidization, a more or less complete pyrolysis and gasification of the fuel takes place in the chamber 1, with the results that the fluidized bed reaching the upper part 20 of the cyclone consists of a mixture of gas and of solid materials containing a high proportion of combustible materials. This mixture is set in a whirling motion as soon as it enters the cyclone and forms a vortex, and this, together with the combined effect of the impact of the particles against the refractory impact surface 20, considerably reduces the vertical velocity of the materials in the cyclone and increases the density of the solid particulate materials in the gases. This vortex effect is augmented by the multi-stage tangential injections of secondary air via the pipelines 30. This plays a part in maintaining a high density of the solid particles in the cylindrical zone of the cyclone. A sufficient quantity of secondary air is injected to produce a thorough combustion of the circulating materials and to maintain a markedly oxidizing atmosphere in the upper part of the cyclone. Due to the effect of the temperature and of the oxidizing atmosphere, a desulfurization of the combustible materials is produced by forming the stable sulfate $CaSO_4$ from the calcium sulfide formed earlier by the reaction of the sulfur in the fuel with the particles of limestone.

Thus, a reaction zone is set up in the upper part 20, 24 of the cyclone 2, in which the vortex effect increases the residence time of the solid particles. Furthermore, the circulation of the gases and particles promotes contact and heat transfer with the heat exchanger 25 in such a way that the transfer surface which is swept by a gas at a high velocity does not become covered by a layer of solids and, as a result, the heat-transfer co-efficient remains high. The walls of the separator tube 27, which promote the separation of the gases from the solid particles, also form transfer surfaces which recover a proportion of the heat of combustion. The burnt gases carrying the fine solid particles in suspension form are entrained inside the vertical tube 27 towards the chamber 21, to form the flue gases discharged via the duct 22. The solid particles recovered by the cyclone fall back into the frusto-conical part 26 of this cyclone and are cooled on contact with the walls of the heat exchanger 28 forming part of the inner wall of the conical frustum 26.

The cooled solid particles then fall back into the circulation duct 3, to be recycled inside the lower part 1*a* of the chamber 1. The ash which is formed is removed at regular intervals via the discharge duct 12.

When a circuit incorporating an external heat exchanger is used, an additional means is available for extracting heat from the recycled solid materials.

It may be seen, therefore, that the principal characteristics of the device, namely the presence of a fluidization chamber which is entirely lined with refractory material and the placing of heat-exchanger bodies in the recirculation cyclone and especially in its upper part, make it possible to achieve an operation with higher densities of solid materials and with much longer residence times of the gas in the reaction zone, using plant which is of the same height. Only partial pyrolysis and gasification of the fuel takes place in the fluidization chamber which precedes the recirculation cyclone, the principal reaction zone being in the upper part of the cyclone. The heat exchanges in this zone are greatly enhanced by a vortex effect, with the result that the heat-exchange surfaces may be considerably reduced, by an amount of the order of 30%. This leads to a considerable reduction in the bulk and cost of construction of the boiler and of its ancillary equipment. Tangential injections into the upper part of the cyclone enable these effects to be augmented.

The upper part 20 of the cyclone, which is lined with refractory material, makes it possible to slow down the circulating particles and hence to reduce the erosion of the transfer walls situated below the zone 20.

The presence of a secondary reaction zone with a widened cross-section at the base of the fluidization column makes it possible to obtain other advantages insofar as process operation is concerned.

The structural arrangements which are adopted enable the plant to be pressurized and, as a result, to be used in a direct-cycle line, i.e., without an external exchanger.

The heat exchanger components may be arranged in a manner which differs from that described; for example, these heat-exchanger components may be strictly limited to the cylindrical upper part of the recirculation cyclone. These heat exchangers may be made in the form of double-skin walls of any type, incorporating means for water distribution and for steam recovery.

The plant may also be constructed in modular form, a single principal body forming the fluidization column being connected up so that it feeds several recirculation cyclones containing heat exchangers.

The recirculation cyclones may be of any known types, so long as they allow the heat exchangers to be placed on their inner wall. In particular, they may of a counterflow type, as in the embodiment just described, or have streams of gas and of recovered particles which travel in the same direction. These cyclones may of any size, since the effects of a tangential circulation of the gases may be completely controlled by virtue of multistage gas injections at various places in the cyclone.

Lastly, the boiler according to the invention may be fed with any fuels or other materials in particulate form, its operation being particularly flexible, by virtue of the internal means or of the attached means which are available for controlling the combustion and the circulation of the fluidized bed.

What is claimed is:

1. A boiler with a circulating fluidized bed utilizing the heat produced by the combustion of circulating materials and comprising an elongate fluidization chamber (1) with a vertical axis and with its inner surface entirely lined with a layer of refractory material (14), at the base of which boiler a combustible material and, if appropriate, a non-combustible solid material are introduced in the form of particles together with an oxidizing gas for suspending solid materials traveling upwards in said chamber (1), at least one recirculation cyclone (2) with a vertical axis, communicating with the upper part of said chamber (1) via a duct (4) substantially tangential to said cyclone (2), a second duct (3) for recycling solid materials placing the lower part of said cyclone (2) in communication with the lower part of said chamber (1), and at least one heat-exchanger component (25, 26, 27) in which water to be heated and vaporized circulates and whose outer transfer surface contacts hot circulating gases and said solid materials, at least one said heat-exchanger component (25, 26, 27) being located inside said cyclone (2) at least in its upper part, said upper part comprising means for injecting air (30) into said circulating fluidized bed, said means being arranged in substantially tangential directions with respect to said cyclone (2) and in stages in the vertical direction, said means (30) ensuring the combustion of said gases and combustible solids circulating in said upper part of said cyclone (2).

2. The fluidized-bed boiler as claimed in claim 1, wherein said cyclone (2) comprises an upper zone (20) of its upper part where an inner wall of said cyclone is lined with a refractory material, said wall being located above said heat-exchanger components (25, 26, 27) which are placed in said cyclone and being subjected to the impact of the circulating solid particles ensuring their deceleration.

3. The fluidized-bed boiler as claimed in claim 1, comprising a separator tube (27) arranged in the upper part of said cyclone (2), along its axis, opening out at one of its ends into said cyclone and at its other end into a flue gas discharge chamber (21) consisting of an exchanger wall (27) in which water circulates.

4. The fluidized-bed boiler as claimed in claim 1, wherein the inner wall of the lower part (26) of the cyclone (2), which is frusto-conical in shape, consists of an exchanger wall (28).

5. The fluidized-bed boiler as claimed in the claim 1, comprising an external heat exchanger in a circuit branching off from said duct (93) for recirculating the solid materials by virtue of pipe-lines for extracting and for reinjecting solid materials (36, 37).

6. The fluidized-bed boiler as claimed in claim 1, wherein said chamber (1) comprises, in its lower part, a widened zone (1*a*) into which the combustible material to be fluidized and the fluidization air are introduced, which is connected to the general part of said chamber (2) of smaller cross-section, via a constriction permitting the trapping of particles of solid materials of large particle size, pre-pyrolysis and gasification of said materials taking place in said widened zone (1*a*).

7. The fluidized-bed boiler as claimed in claim 6, wherein said duct (3) for recirculating said solid materials opens out, at its outlet end, into the widened zone (1*a*), in which mixing of the recirculated solid materials with the new solid materials introduced at the base of said chamber (1) takes place.

* * * * *